United States Patent [19]

Saka et al.

[11] Patent Number: 4,485,770

[45] Date of Patent: Dec. 4, 1984

[54] MATERIAL FOR VALVE-ACTUATING MECHANISM OF INTERNAL COMBUSTION ENGINE

[75] Inventors: Tsutomu Saka, Saitama; Toshihiro Kamiyama, Tokyo; Hiroyuki Endo; Yutaka Ikenoue, both of Chiba, all of Japan

[73] Assignees: Honda Giken Kogyo Kabushiki Kaisha, Tokyo; Hitachi Powdered Metals Company, Ltd., Chiba, both of Japan

[21] Appl. No.: 333,464

[22] Filed: Dec. 22, 1981

[30] Foreign Application Priority Data

Dec. 24, 1980 [JP] Japan ..... 55-181916

[51] Int. Cl.[3] ..... C22C 38/12; C22C 38/14

[52] U.S. Cl. ..... 123/90.39; 123/90.44; 123/90.51; 123/90.6

[58] Field of Search ..... 123/90.51, 90.6, 90.39, 123/90.44

[56] References Cited

U.S. PATENT DOCUMENTS

| | | | |
|---|---|---|---|
| 3,124,869 | 3/1964 | Behnke et al. | 123/90.51 |
| 3,977,838 | 8/1976 | Hashimoto et al. | 29/182.5 |
| 4,147,074 | 4/1979 | Noguchi et al. | 123/90.39 |
| 4,230,491 | 11/1980 | Behnke | 123/90.51 |
| 4,363,659 | 12/1982 | Hickl | 420/454 |

FOREIGN PATENT DOCUMENTS

| | | | |
|---|---|---|---|
| 0097115 | 8/1978 | Japan | 123/90.39 |
| 0057008 | 5/1979 | Japan | 123/90.44 |
| 0810042 | 9/1958 | United Kingdom | 123/90.51 |
| 0944894 | 12/1963 | United Kingdom | 123/90.51 |
| 2073247 | 3/1980 | United Kingdom | 123/90.51 |

*Primary Examiner*—Craig R. Feinberg
*Assistant Examiner*—David A. Okonsky
*Attorney, Agent, or Firm*—Irving M. Weiner; Pamela S. Burt; Anthony L. Cupoli

[57] ABSTRACT

A material, and a process for producing same, for fabricating components of valve-actuating mechanisms of internal combustion engines, the material comprising an iron-base sintered alloy, which comprises, by weight: 2–7% Cr (chromium); 0.1–1.5% Mo (molybdenum); 0.5–7% W (tungsten); 0.1–3% V (vanadium); and 0.5–3% C (carbon). Upon being subjected to a slide-contact with another member, the material exhibits a high degree of abrasion resistance and at the same time is capable of effectively protecting the material of a member operatively cooperating therewith in slide-contact. The material is thus highly suitable for very frequent slide-contact with a cam member or the like.

5 Claims, 4 Drawing Figures

MATERIAL FOR VALVE-ACTUATING MECHANISM OF INTERNAL COMBUSTION ENGINE

BACKGROUND OF THE INVENTION

1. Field of the Invention

The present invention relates to a material, and a process for producing same, which is suitable for use in fabricating components of the valve-actuating mechanism of an internal combustion engine. More particularly, the invention relates to a material suitable for fabricating members subjected to very frequent slide-contact with a cam member, i.e., for members such as rocker arms and valve lifters which make up the valve-actuating mechanism of an internal combustion engine.

2. Description of Relevant Art

Valve-actuating mechanism components of internal combustion engines, particularly members such as rocker arms and valve lifters which are repeatedly subjected to very frequent slide-contact with a cam, require for their fabrication a material having special properties.

With reference to the accompanying drawings, the general structure of valve-actuating mechanisms of internal combustion engines will be described.

An example of an OHC-type valve-actuating mechanism of an internal combustion engine is shown in FIG. 1. In response to rotation of a cam 2, a rocker arm 1 undergoes a seesaw motion, and thereby the rocker arm 1 alternatingly opens and closes a valve 5. In a valve-actuating mechanism of this type, the abrasion resistance of the working face of the rocker arm 1, which working face is brought into frequent slide-contact with the cam 2, becomes the most critically important feature.

With reference to FIG. 2, there is shown an example of a valve-actuating mechanism of the push rod type. A valve lifter 3 and push rod 4 are interposed between the cam 2 and rocker arm 1, thereby transmitting the motion of the cam 2 to the valve 5. In a valve-actuating mechanism of such type, the most critical feature resides in the abrasion resistance of the working face of the valve lifter 3, which working face is brought into frequent slide-contact with the cam 2.

In each of the above-described types of valve-actuating mechanisms, it is of course important that the aforesaid working faces have superior abrasion resistance as mentioned above. In addition, it is also important that the working face does not wear or abrade the cam 2, which is the member operatively cooperating with the working face.

The aforesaid members have heretofore been fabricated generally of an iron-base material such as a steel or alloyed cast iron. In order to enhance their abrasion resistance, prior to their use, the working faces cooperating with the cam 2 have been subjected to a treatment such as surface hardening through heat treatment, chilling, hard chromium plating or flame spraying of an autogeneous alloy.

However, such treated prior art materials have attendant problems, such as that carburized steel is poor in durability, and a hard chromium plated material is likely to be subject to chipping-off due to localized contacts or abrasion. On the other hand, where an autogeneous alloy is flame-sprayed, there arises another disadvantage with regard to fabrication cost due to increased fabrication steps and use of expensive raw materials as well as uncertainty in providing quality assurance, due to the inclusion of the flame-spraying step.

In view of the foregoing problems, there has developed a desideratum for superior materials for use in fabricating components of valve-actuating mechanisms of internal combustion engines. The present invention eminently fulfills such desideratum, and effectively overcomes the foregoing problems attendant prior art materials used in fabricating components of valve-actuating mechanisms of internal combustion engines.

SUMMARY OF THE INVENTION

An object of the present invention is to provide a material for fabricating components of valve-actuating mechanisms of internal combustion engines, which material exhibits a high degree of abrasion resistance even when subjected to very frequent slide-contact and at the same time is capable of effectively protecting the material of a member operatively cooperating therewith. Thus, the material in accordance with the present invention is highly suitable for very frequent slide-contact with a cam member or the like.

Another object of the present invention is to provide a process for producing a material which per se has a high degree of abrasion resistance, but on the other hand has an extremely low degree of wearing-off of material operatively cooperating therewith in slide-contact. The material produced in accordance with the present invention is thus highly suitable for use in fabricating components of valve-actuating mechanisms of internal combustion engines or the like, which components are subjected to very frequent slide-contact.

A further object of the present invention is to provide members for valve-actuating mechanisms of internal combustion engines, which members are fabricated of a material having a high degree of abrasion resistance and excellent anti-friction characteristics with respect to members operatively cooperating therewith, and thus being highly suitable for very frequent slide-contact.

In accordance with the present invention there is provided a material for fabricating components of valve-actuating mechanisms of internal combustion engines, comprising an iron-base sintered alloy which comprises by weight: 2–7% Cr (chromium); 0.1–1.5% Mo (Molybdenum); 0.5–7% W (tungsten); 0.1–3% V (vanadium); and 1.5–3% C (carbon).

The present invention also provides a process for producing iron-base alloys comprising the steps of: mixing powdery raw materials to obtain a weight composition comprising 2–7% CR (chromium), 0.1–1.5% Mo (molybdenum), 0.5–7% W (tungsten), 0.1–3% V (vanadium), 0.5–3% C (carbon), 0.1–2% P (phosphorus), and the remainder FE (iron) and unavoidable impurities; pressing the thus mixed raw materials to shape them into the configuration of a desired member; sintering the thus-shaped raw materials under predetermined conditions; and subjecting the thus-sintered raw materials to a heat treatment so as to obtain a predetermined iron-base alloy structure.

The present invention also provides a rocker arm or valve lifter for a valve-actuating mechanism of an internal combustion engine, the mechanism being adapted to drive the rocker arm either directly or through the valve lifter and a push rod by a cam. The working face portion of the rocker arm or valve lifter in accordance with the invention, which working face portion is adapted to be brought into slide-contact with the cam, is formed of an iron-base sintered alloy comprising by weight: 2–7% Cr; 0.1–1.5% Mo; 0.5–7% W; 0.1–3% V; 1.5–3% C; 0.1–2% P; and the remainder Fe and unavoidable impurities.

Other objects, details and features of the present invention will become apparent from the following detailed description of preferred embodiments thereof.

DETAILED DESCRIPTION OF PREFERRED EMBODIMENTS

The following detailed description relates to an embodiment of the present invention as applied to a rocker arm.

Figure 1:
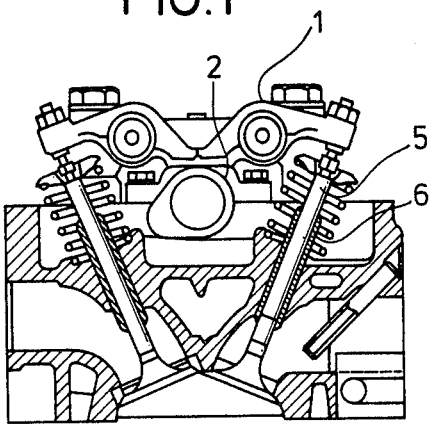
FIGS. 1 and 2 are cross-sectional views showing, respectively, valve-actuating mechanisms of two general types for use in internal combustion engines.
Figure 2:
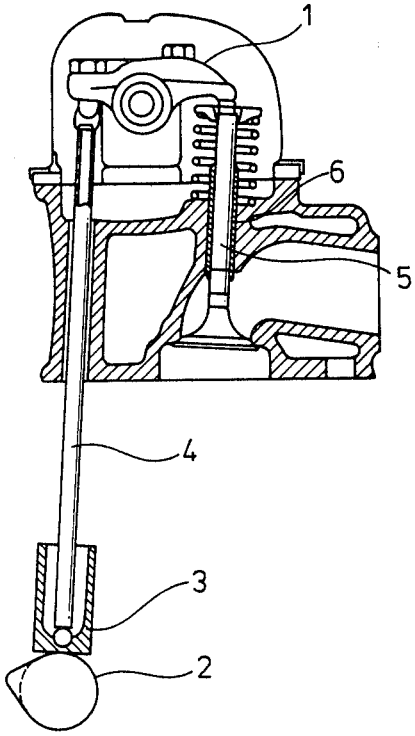
Figure 3:
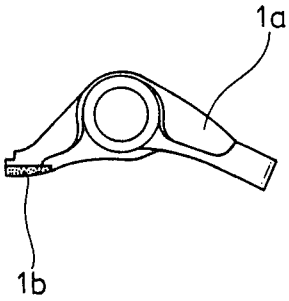
FIG. 3 is an enlarged view of a rocker arm.

As illustrated in FIG. 3, the main body 1*a* of the rocker arm, other than its working face which operatively cooperates with a cam, was fabricated of a low-alloy steel. A pad 1*b* made of an alloy according to the present invention was bonded to a portion corresponding to the working face. The thus fabricated rocker arm was subjected to various measurements and tests.

Example: Iron powder, graphite powder, iron-phosphorus powder, alloy steel powder, etc., were proportioned and mixed to obtain substantially the following compositions by weight:

Sample 1: 4.3% Cr, 5.0% W, 1.7% C, 1.0% Mo, 0.3% V, 0.4% P, and the remainder Fe.

Sample 2: 5.4% Cr, 1.8% W, 2.0% C, 0.5% Mo, 0.2% V, 0.5% P, and the remainder Fe.

The materials were then pressed under a forming pressure of 6 tons/cm$^2$ into the configuration of a desired pad, and sintered and heat-treated under the following conditions, thereby preparing Sample 1 and Sample 2:

| | Sample 1 | Sample 2 |
|---|---|---|
| Sintering atmosphere | vacuum ($1 \times 10^{-3}$ mmHg) | vacuum |
| Sintering temperature | 1200° C. | 1200° C. |
| Hardening conditions | in Ar gas | in quenching oil |
| Hardening temperatures | 1200° C. | 900° C. |
| Tempering temperatures | 550° C. | 200° C. |

The resultant samples had a structure containing a martensite matrix and a hardened material distributed in a network pattern throughout the matrix. The densities of the sinters and their hardnesses were as follows:

| | Sample 1 | Sample 2 |
|---|---|---|
| Density of sinter (g/cm$^3$) | 7.4 | 7.5 |
| Hardness ($H_RC$) | 50–65 | 55–70 |

Thereafter, each of the pads 1*b* was bonded to the rocker arm 1*a* and assembled in a water-cooled 1800 cc engine with four cylinders arranged in a line. The state of abrasion of the pad 1*b* and cam 2 were compared through a bench test with those of a pad and cam which were made of a conventional material. In the test, the engine was continuously operated at 2000 rpm while maintaining its motor oil (SAE 10W-30) at 45±5° C. After a lapse of 250 hours, the engine was disassembled and the amount of abrasion of each material was measured.

Figure 4:
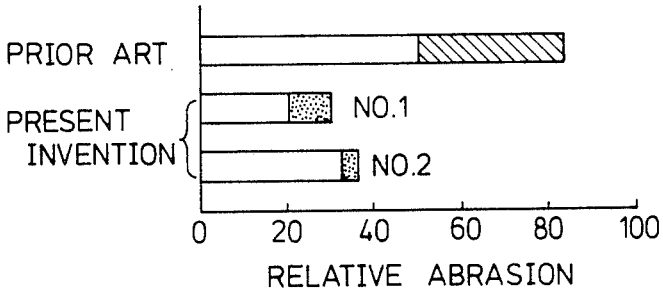
FIG. 4 is a bar graph showing the state of abrasion of material for fabricating components of valve-actuating mechanisms of internal combustion engines according to the present invention in comparison with that of a conventional material, as obtained from an engine bench test.

FIG. 4 depicts the results of the above test in the form of a bar graph, wherein in each histogram the white and dotted or the white and hatched sections represent respectively the amount of abrasion of the cam top portion and that of the working face of the rocker arm. The histograms bearing dots relate to materials according to the present invention, while the histogram including hatchings relates to the conventional material.

The working face of each of the rocker arms and the material or surface treatment of its corresponding cam were combined as follows:

| Sample | Cam | Working face (pad) |
|---|---|---|
| Conventional example | Chilled low-alloy steel | Hard chromium plating |
| No. 1 | Chilled low-alloy steel | Sample No. 1 |
| No. 2 | Chilled low-alloy steel | Sample No. 2 |

As apparent from the graph of FIG. 4, when the material of Sample 1 was used as the pad material, the amount of overall abrasion of the cam and working face was decreased to about 36% of that of the conventional material.

As shown by the above test results, the material according to the present invention is capable of considerably reducing the abrasion of both a cam and the member which is brought into operatively cooperating slide-contact with the cam, as well as improving their overall abrasion characteristics. Accordingly, the present invention is extremely useful in prolonging the service life of a valve-actuating mechanism.

The weight composition of a material according to the present invention will hereinafter be described in detail. The abrasion resistance of a material according to the present invention has been increased, principally, by causing a hard phase of metal carbides to be dispersed throughout its martensite matrix. At the same time, the improved abrasion resistance of a cam is attributed to an appropriate selection of types of metal carbides, the amounts thereof, and the combination thereof.

The particulars of the weight composition of the material according to the invention are as follows:

Cr: While reinforcing the martensite matrix, it reacts with C to form a hard carbide, thereby improving the abrasion resistance. However, when used in an amount less than 2%, its specific effect would not be attained. On the other hand, an amount greater than 7% results in disadvantages such as brittleness of the material and lower machinability thereof.

Mo: Similar to Cr, while reinforcing the martensite matrix, it reacts with C to form a hard carbide, thereby improving the abrasion resistance. However, an amount less than 0.1% does not bring about the desired particular effect, while an amount greater than 1.5% renders the operatively cooperating material susceptible to damage.

W: Also similar to Cr, it reinforces the martensite matrix and, at the same time, reacts with C to form a hard carbide, thereby improving the abrasion resistance. However, when added in an amount less than 0.5%, the desired specific effect is not attained. On the other hand, an amount greater than 7% results in brittleness of the material.

V: It reacts with C to form a carbide, thereby contributing to an improvement of the abrasion resistance. However, an addition of less than 0.1% does not bring about the desired specific effect, while an amount greater than 3% lowers the machinability of the material and renders the operatively cooperating material susceptible to damage.

C: While reinforcing the martensite matrix, it reacts, as described above, with Cr and other additive components to cause a hard phase to be deposited, thereby improving the abrasion resistance. However, when added in an amount less than 1.5%, its desired effect may not be fully attained. On the other hand, if added in an amount greater than 3%, the toughness of the material would be impaired.

P: P is a sintering agent, by which the raw material mixture is allowed to undergo liquid phase sintering so as to highly densify the iron-base sintered alloy. An addition of less than 0.1% does not bring about the desired effect. On the other hand, an addition beyond 2% is not preferred because the liquid phase is produced to too great an extent and its dimensional stability is considerably lowered during sintering work.

Although there have been described what are at present considered to be the preferred embodiments of the invention, it will be understood that the present invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

We claim:

1. A material for fabricating components of valve-actuating mechanisms of internal combustion engines, consisting of an iron-base sintered alloy consisting of by weight:

2–7% Cr (chromium);
0.1–1.5% Mo (molybdenum);
0.5–7% W (tungsten);
0.1–3% V (vanadium);
1.5–3% C (carbon);
0.1–2% P (phosphorus); and
the remainder Fe (iron).

2. A slide-contact member for a valve-actuating mechanism of an internal combustion engine, said mechanism being adapted to drive a rocker arm through a valve lifter and a push rod by a cam, characterized in that:

a working face portion of said slide-contact member is adapted to be brought into slide-contact with said cam, and is formed of an iron-base sintered alloy consisting of by weight:

2–7% Cr (chromium);
0.1–1.5% Mo (molybdenum);
0.5–7% W (tungsten);
0.1–3% V (vanadium);
1.5–3% C (carbon);
0.1–2% P (phosphorus); and
the remainder Fe (iron).

3. A slide-contact member for a valve-actuating mechanism of an internal combustion engine, said mechanism being adapted to drive a rocker arm directly by a cam, characterized in that:

a working face portion of said slide-contact member is adapted to be brought into slide-contact with said cam, and is formed of an iron-base sintered alloy consisting of by weight:

2–7% Cr (chromium);
0.1–1.5% Mo (molybdenum);
0.5–7% W (tungsten);
0.1–3% V (vanadium);
1.5–3% C (carbon);
0.1–2% P (phosphorus); and
the remainder Fe (iron).

4. A slide-contact member according to claim 3, wherein:

said slide-contact member comprises a rocker arm.

5. A slide-contact member according to claim 3, wherein:

said slide-contact member comprises a valve lifter.

* * * * *